US006634705B1

(12) United States Patent
Zheng

(10) Patent No.: US 6,634,705 B1
(45) Date of Patent: Oct. 21, 2003

(54) ARMREST ARRANGEMENT FOR FOLDABLE CHAIR

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 10/216,693

(22) Filed: Aug. 12, 2002

(51) Int. Cl.[7] ..... A47C 4/00
(52) U.S. Cl. ..... 297/41; 297/45
(58) Field of Search ..... 297/45, 55, 41, 297/38

(56) References Cited

U.S. PATENT DOCUMENTS 2,787,316 A * 4/1957 Moore et al.
4,014,591 A * 3/1977 Gittings
4,685,725 A * 8/1987 Helfrich
6,082,813 A * 7/2000 Chen
6,179,374 B1 * 1/2001 Tang
6,454,348 B1 * 9/2002 Wu

* cited by examiner

*Primary Examiner*—Milton Nelson, Jr.
(74) *Attorney, Agent, or Firm*—Raymond Y. Chan; David and Raymond Patent Group

(57) ABSTRACT

An armrest arrangement, which is incorporated with a chair frame, includes two arm rests pivotally connected to two back supporting arms of a chair frame respectively and two arm supports, which are pivotally connected to two seat side supports of the chair frame respectively, each having an upper end slidably connected to the respective arm rest for supporting the arm rest at an unfolded position of the chair frame. At a folded position, the arm rests are pivotally and upwardly folded towards the back supporting arms respectively so as to fold up the chair frame correspondingly, and at the unfolded position, the arm rests are pivotally folded to transversely extended from the back supporting arms so as to provide two arm resting surfaces respectively for substantially supporting user's arms thereon.

32 Claims, 6 Drawing Sheets

ARMREST ARRANGEMENT FOR FOLDABLE CHAIR

BACKGROUND OF THE PRESENT INVENTION

1. Field of Invention

The present invention relates to a collapsible chair, and more particularly to an armrest arrangement for a collapsible chair, wherein the armrest arrangement not only provides a substantial arm support for a user but also enhances the rigid structure for the collapsible chair.

2. Description of Related Arts

Generally speaking, there are two types of chair, which are the foldable chair and the collapsible chair, adapted to be folded up for use and unfolded for storage. A foldable chair comprises a chair frame and a seat frame pivotally connected to the chair frame. The distinctive feature of the foldable chair is that it can provide a substantial seat support for the user such that the user is able to sit on the foldable chair comfortably. However, the foldable chair cannot be folded up into a compact unit so that the foldable chair requires a relatively larger storage space.

A conventional collapsible chair comprises a collapsible chair frame constructed by metal tubes and a seat fabric. The collapsible chair frame comprises a plurality of construction tubes to construct a back frame and a sear frame for supporting the fabric seat. The seat frame comprises a front pair, a back pair and two side pairs of construction tubes, wherein each pair of the construction tubes are pivotally connected together where they cross so that the chair frame can be easily unfolded to provide a cross-support for use and be folded up for storage.

Because such a conventional collapsible chair can be quickly and easily unfolded for use and folded into a compact for carriage, a user can carry the collapsible chair to everywhere such as campground or beach. However, the cross-support of the seat frame cannot substantially support the weight of the user.

Accordingly, the collapsible chair further comprises a plurality of frame joints pivotally connecting the ends of the construction tubes to form the seat frame wherein the frame joints are capable of not only distributing the weight of the user through the seat frame but also retaining the collapsible chair frame in an unfolded position. Therefore, when the user sits on the seat frame, all the stresses will be created around the frame joints. As s result, the frame joints will be distorted or even permanently misshapen over a period of continued use. Furthermore, since the bottom frame joints have a flat bottom surface, the collapsible chair can only be set up on a flat ground surface. In other words, when the collapsible chair is set up on the non-flat group surface, the collapsible chair is in an unstable manner.

In addition, when the user sits on the collapsible chair, the downward pulling force is applied on the seat fabric such that the seat fabric will be stretched to the center thereof. Therefore, most of the users of the conventional collapsible chair have an intention to plunge into the chair frame downwardly.

Moreover, due to the originally structural design of the collapsible chair frame, the conventional collapsible chair cannot incorporate with an armrest support. In order to provide the armrest support, the collapsible chair frame must be altered to fit the structure of the armrest support. In addition, when the armrest support is incorporated with the collapsible chair frame, the structure of the seat frame will be weakened. Thus, the armrest support may affect the folding operation of the collapsible chair, so that the collapsible chair cannot be folded up into a compact unit anymore.

SUMMARY OF THE PRESENT INVENTION

A main object of the present invention is to provide a foldable chair, wherein an armrest arrangement of the foldable chair not only provides a substantial arm support for a user but also evenly distribute and support the downward pulling force and stress applied by the user's weight.

Another object of the present invention is to provide a foldable chair, which not only substantially enhances the supporting area of the chair seat to more evenly distribute the weight of the user but also provides a cushion effect of the chair seat without using any foaming material so as to minimize the manufacturing cost of the foldable chair.

Another object of the present invention is to provide a foldable chair, wherein the lower portion of the user's thigh can be well supported without increasing the front frame and the rear frame, i.e. the folding size of the chair frame. In other words, the chair frame of the present invention is more comfortable and capable of supporting more weight in comparison with the conventional chair frame having the same frame structure and size.

Another object of the present invention is to provide a foldable chair, wherein the chair frame provides four ground supporting posts such that the foldable chair is capable of stably setting up on a non-flat ground surface.

Another object of the present invention is to provide a foldable chair, wherein the chair frame provides an angled-side enhancement structure instead of using the cubic structure of the conventional collapsible chair frame so as to enhance the rigid structure of the foldable chair.

Another object of the present invention is to provide a foldable chair, which is adapted for being folded into a compact unit for easily storage and carriage. Moreover, the foldable chair has a simple construction that every individual is able to fold and unfold the foldable chair in one single motion.

Accordingly, in order to accomplish the above objects, the present invention provides a foldable chair comprising a chair frame and a chair seat supported by the chair frame, wherein the chair frame has a seat portion and a ground portion, and comprises:

a front frame comprising a first front frame leg and a second front frame leg pivotally connected with each other to form a "X" structure;

a rear frame comprising a first rear frame leg and a second rear frame leg pivotally connected with each other to form a "X" structure;

two side frames, each comprising a seat side support, a front side frame leg upwardly and rearwardly extending to pivotally connect with the seat side support, and a rear side frame leg upwardly and frontwardly extending to pivotally to connect with the seat side support, wherein the first and second front frame legs of the front frame are pivotally connected between a front side the side frames and the first and second rear frame legs of the rear frame are pivotally connected between a rear side of the side frames to define the seat portion of the chair frame, wherein a bottom portion of each of the front and rear side frame legs defines the ground portion of the chair frame and forms as a ground supporting post for supporting the chair frame; and means for retaining the chair frame at an unfolded position, wherein at the unfolded position, the front side frame leg is pivotally moved to the rear side frame leg of each of the side frames at a predetermined folding angle while the front and rear frames are pivotally folding to lengthen a distance between the side frames, and at a folded position, the front side frame leg is pivotally moved toward the rear side frame leg of each of the side frames to minimize the folding angle thereof while the front and rear frames are pivotally folding to minimize the distance between the two side frames.

DETAILED DESCRIPTION OF THE PREFERRED EMBODIMENT

Figure 1:
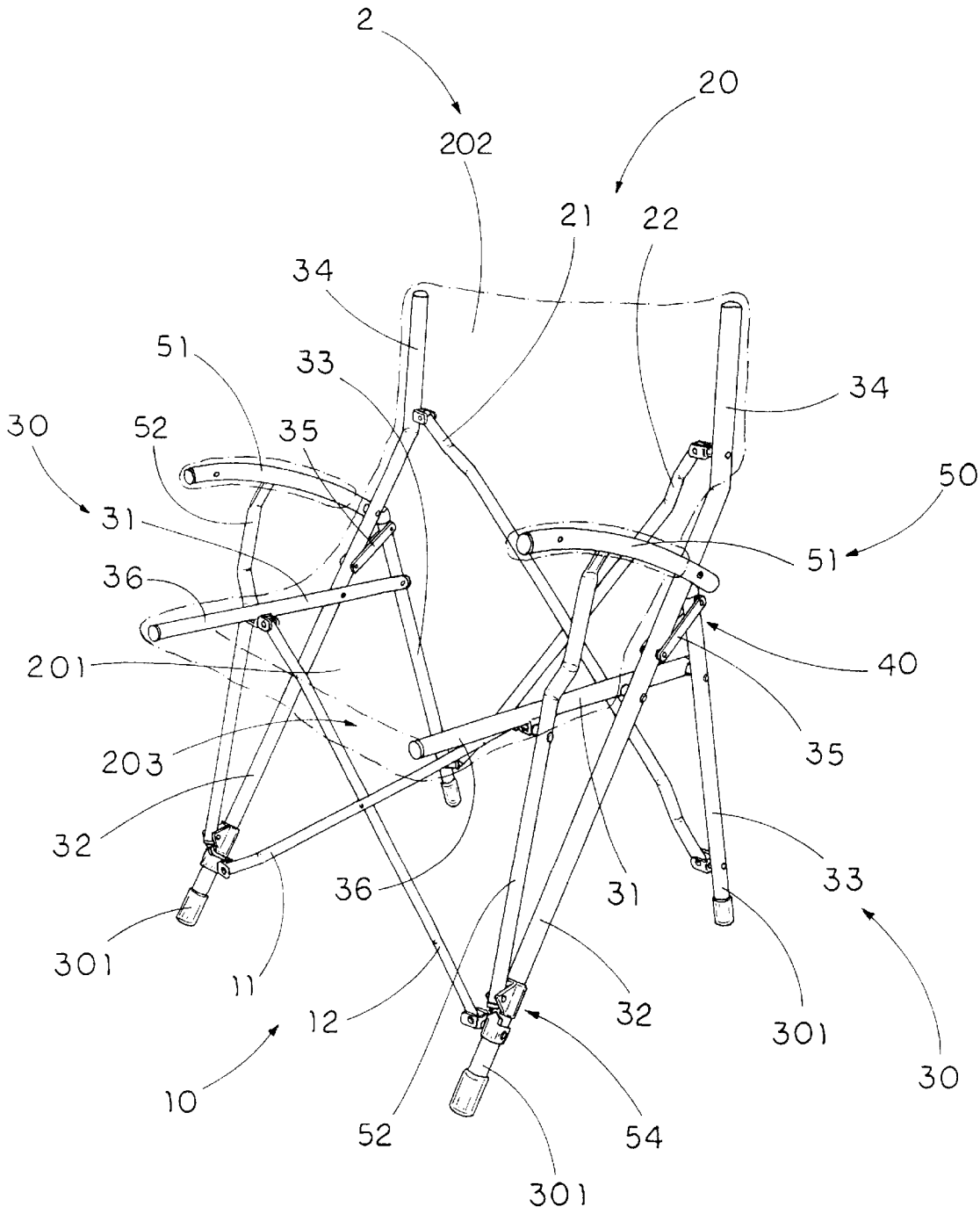
FIG. 1 is a perspective view of a foldable chair incorporated with an armrest arrangement according to a first preferred embodiment of the present invention.
Figure 2:
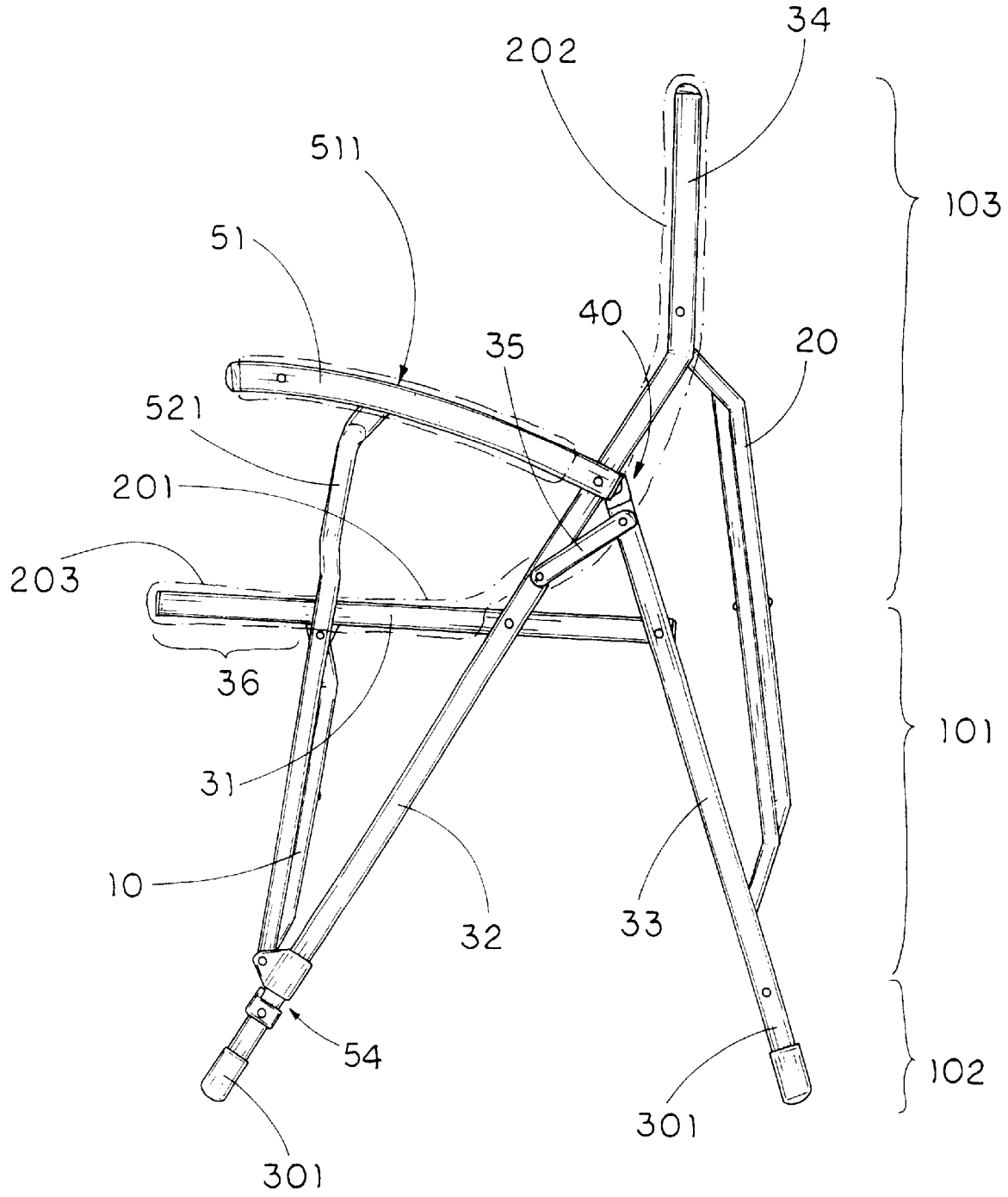
FIG. 2 is a side view of the foldable chair according to the above first preferred embodiment of the present invention.

Referring to FIGS. 1 and 2 of the drawings, a foldable chair according to a first preferred embodiment is illustrated, wherein the foldable chair comprises a chair frame 1 and a chair seat 2 supported by the chair frame 1.

The chair frame 1 has a seat portion 101 and a ground portion 102 wherein the chair 1 comprises a front frame 10 comprising a first front frame leg 11 and a second front frame leg 12 pivotally connected with each other to form a "X" structure and a rear frame 20 comprising a first rear frame leg 21 and a second rear frame leg 22 pivotally connected with each other to form a "X" structure.

The chair frame 1 further comprises two side frames 30 and means 40 for retaining the chair frame 1 in an unfolded position.

Each of the side frames 30 comprises a seat side support 31, a front side frame leg 32 upwardly and rearwardly extending to pivotally connect with the seat side support 31, and a rear side frame leg 33 upwardly and frontwardly extending to pivotally to connect with the seat side support 31. Each of the side frames 30 further comprises a back supporting arm 34 upwardly extended from the respective seat side support 31 to form a back support portion 103 of the chair frame 1.

The first and second front frame legs 11, 12 of the front frame 10 are pivotally connected between a front side the side frames 30 and the first and second rear frame legs 21, 22 of the rear frame 20 are pivotally connected between a rear side of the side frames 30 to define the seat portion 101 of the chair frame 1, wherein a bottom portion of each of the front and rear side frame legs 32, 33 defines the ground portion 102 of the chair frame 1 and forms as a ground supporting post 301 for supporting the chair frame 1. In other words, the seat portion 101 of the chair frame 1 is positioned between the back supporting portion 103 and the ground portion 102 thereof.

Figure 5:
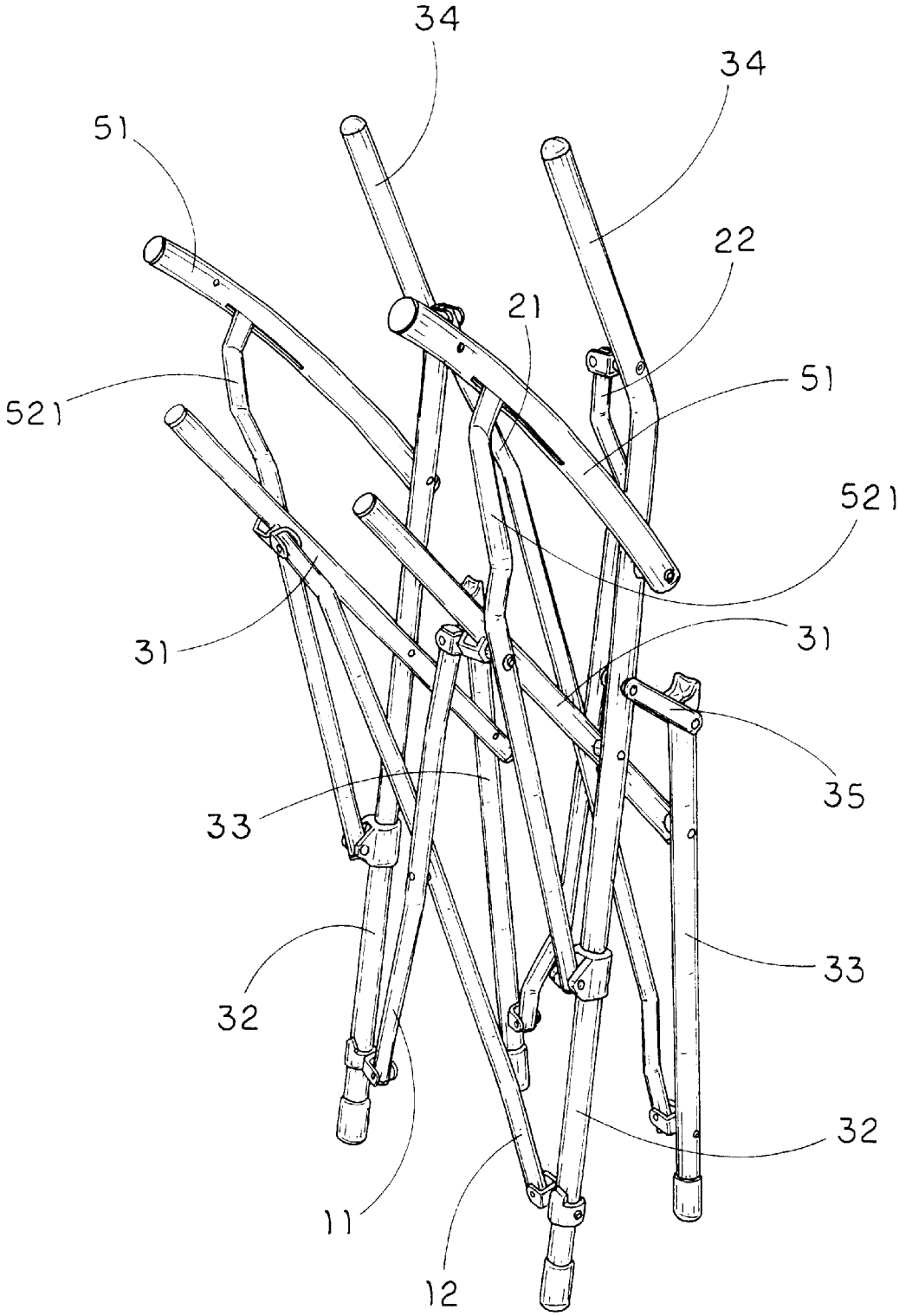
FIG. 5 is a perspective view of the foldable chair in a folded condition according to the above first preferred embodiment of the present invention.

As shown in FIG. 5, at the unfolded position, the front side frame leg 32 is pivotally moved to the rear side frame leg 33 of each of the side frames 30 at a predetermined folding angle A while the front and rear frames 10, 20 are pivotally folding to lengthen a distance between the side frames 30. In which, at a folded position as shown in FIG. 1, the front side frame leg 32 is pivotally moved toward the rear side frame leg 33 of each of the side frames 30 to minimize the folding angle A thereof while the front and rear frames 10, 20 are pivotally folding to minimize the distance between the two side frames 30.

According to the preferred embodiment, the chair seat 2, which is preferably made of durable fabric, comprises a seat support 201 supported by the seat side supports 31 and a back support 202 supported by the back supporting arms 34, wherein two side edge portions of the seat support 201 are substantially mounted to the seat side supports 31 respectively so as to enhance the tension of the seat support 201 when the chair frame 1 is unfolded. In other words, the seat side supports 31 are capable of substantially increasing the supporting contact area of the seat support 201 to more evenly distribute and support the downward force of the user's weight and to provide a cushion effect of the chair seat 2. Therefore, no foaming material is required to employ with the seat support 201 in order to provide a cushion effect of the chair seat 2.

Two upper ends of the first and second front frame legs 11, 12 of the front frame 10 are pivotally connected to the seat side supports 31 respectively while two bottom ends of the first and second front frame legs 11, 12 are pivotally connected to lower portions of the front side frame legs 32 respectively in such a manner that the seat side supports 31 are substantially supported by the front side frame legs 32 respectively through the front frame 10, so that the downward pulling force of the user's weight is capable of evenly distributing through the entire chair frame 1.

Moreover, two upper ends of the first and second rear frame legs 21, 22 of the rear frame 20 are pivotally connected to the back supporting arms 34 respectively while two bottom ends of the first and second rear frame legs 21, 22 are pivotally connected to the rear side frame legs 33 respectively, so that the back supporting arms 34 are substantially supported by the rear frame 20 and are inclinedly extended from the seat side supports 31 to provide an inclined back support for the user is lying on the foldable chair naturally and comfortably.

As shown in FIG. 2, the chair seat 2 further comprises a thigh supporting flap 203 integrally and frontwardly extended from a front end of the seat support 201. Each of the side frames 30 further comprises a thigh supporting arm 36 which are frontwardly and integrally extended from the respective seat side support 31, wherein the thigh supporting arms 36 are connected to two side edges of the thigh supporting flap 203 respectively to evenly support the seat support 201 in such a manner that the thigh supporting flap 203 of the chair seat is firmly supported to extend frontwardly so as to substantially increase a seat area of the seat support 201 of the chair seat 2. In other words, the seat area of the chair seat 2 is capable of substantially increasing by frontwardly extending the seat side supports 31 without altering the original structure of the chair frame 1.

The front side frame legs 32 of the side frames 30 are integrally extending above the seat side supports 31 to form the back supporting arms 34 respectively. The back side frame legs 33 of the side frames 30 are upwardly extended to pivotally connected to two rear ends of the seat side supports 31 respectively wherein two upper ends of the back side frame legs 33 are extended to bias against the back supporting arms 34 respectively when the chair frame 1 is unfolded to stretch out, as shown in FIG. 2. In other words, at the unfolded position of the chair frame 1, the back side frame legs 33 are biased against the front side frame legs 32 respectively to form the folding angle A therebetween so as to substantially supporting a user's weight applied on the chair seat 2 and evenly distribute the downward pulling force of the user's weight through the entire chair frame 1. Therefore, the upper ends of the rear frame legs 32 are embodied as the retaining means 40 to retain the chair frame 1 in the unfolded position.

In order to guide the upper ends of the rear side frame legs 33 to bias against the back supporting arms 34 respectively, the side frame 30 further comprises two guiding members 35 each having two ends pivotally connected to the rear side frame leg 33 and the back supporting arm 34 of the side frame 30 respectively, in such a manner that the guiding members 35 are arranged to guide the upper ends of the rear side frame legs 33 folding towards the back supporting arms 34 until the upper ends of the rear side frame legs 33 bias against the back supporting arms 34 respectively.

Figure 3:
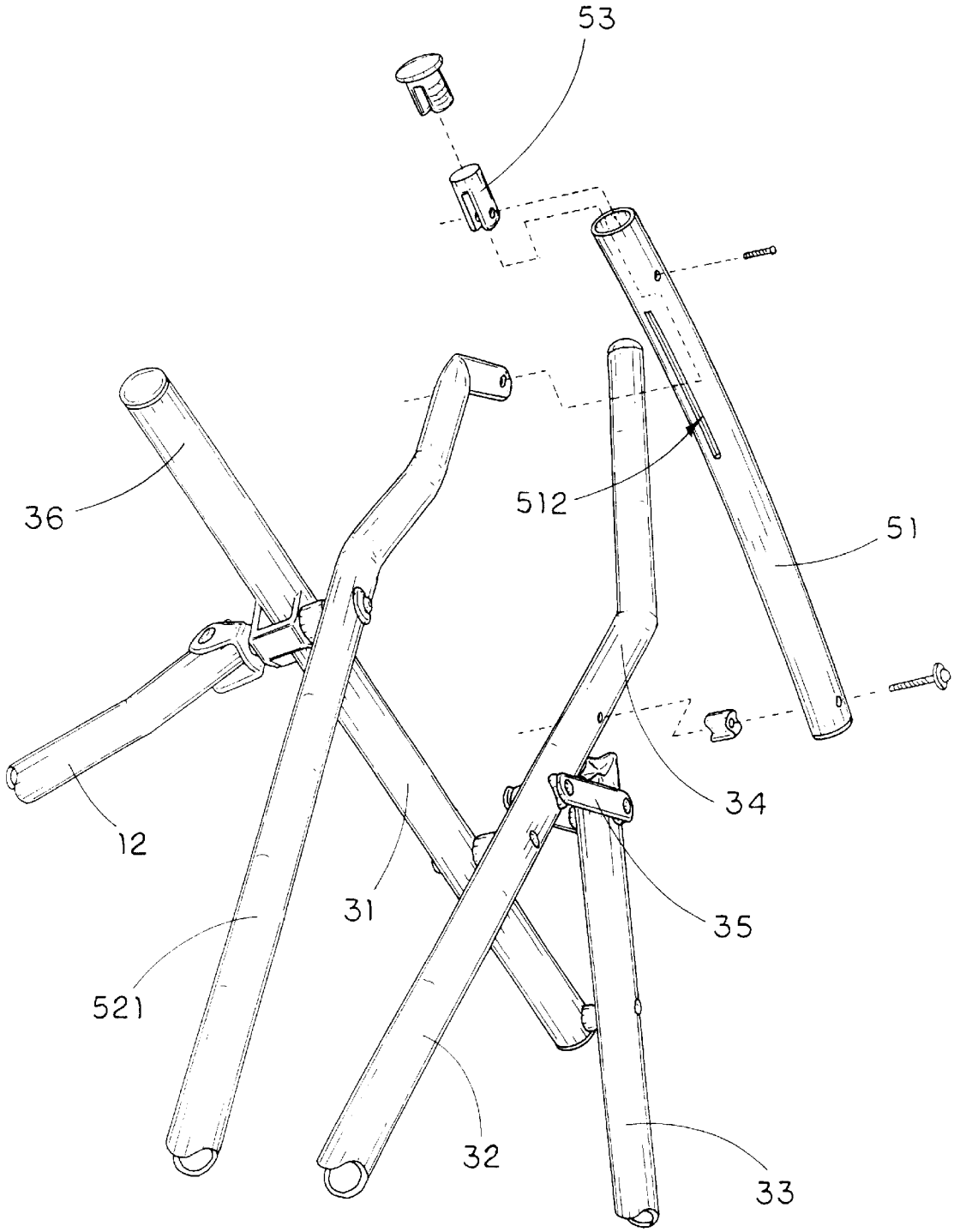
FIG. 3 is a perspective view of the armrest arrangement of the foldable chair according to the above first preferred embodiment of the present invention.

As shown in FIG. 3, the folding chair further comprises an armrest arrangement 50 which comprises two arm rests 51 pivotally connected to the back supporting arms 34 respectively and means 52 for supporting the arm rests 51 at the unfolded position of the chair frame 1, wherein at the folded position, the arm rests 51 are pivotally and upwardly folded towards the back supporting arms 34 respectively, and at the unfolded position, the arm rests 51 are pivotally folded to transversely extended from the back supporting arms 34 so as to provide two arm resting surfaces 511 respectively for substantially supporting user's arms thereon.

According to the preferred embodiment, the supporting means 52 comprises two arm supports 521, which are pivotally connected to the seat side supports 31 respectively, each having an upper end slidably connected to the respective arm rest 51 in such a manner that when the arm rests 51 are upwardly folded towards the back supporting arms 34 respectively, the seat side supports 31 are pivotally pulled upward through the arm supports 521 respectively, so as to fold up the chair frame 1. In other words, the user is able to fold the foldable chair in one single motion by simply pulling up the arm rests 51.

As shown in FIG. 2, the arm supports 521 are extended downwardly until bottom ends of the arm supports 521 are slidably connected to the front side frame legs 32 respectively, so as to enhance the rigid structure of the chair frame 1. Therefore, the seat side supports 31 are also supported by the armrest arrangement 30 so as to further enhance the substantial support of the seat support 201 of the chair seat 2.

As shown in FIG. 3, each of the arm rests 51, having a tubular shaped, has an elongated slider slot 512 provided along a bottom side thereof. The armrest arrangement 50 further comprises two sliding members 53 slidably inserted into the arm rests 51 respectively wherein the upper ends of the arm supports 521 are pivotally connected to the sliding members 53 through the slider slots 512 respectively in such a manner that when the arm rests 51 are pivotally folded with respect to the back supporting arms 34, the upper ends of the arm supports 521 are guided to slide along the slider slots 512 of the arm rests 51 respectively.

It is worth mentioning that the arm supports 521 can be constructed that the upper ends of the arm supports 521 are slidably connected to the arm rests 51 respectively while the bottom ends of the arm supports 521 are slidably connected to the front side frame legs 32 respectively such that the arm supports 521 do not pivotally connected to the seat side supports 31 respectively.

Figure 4:
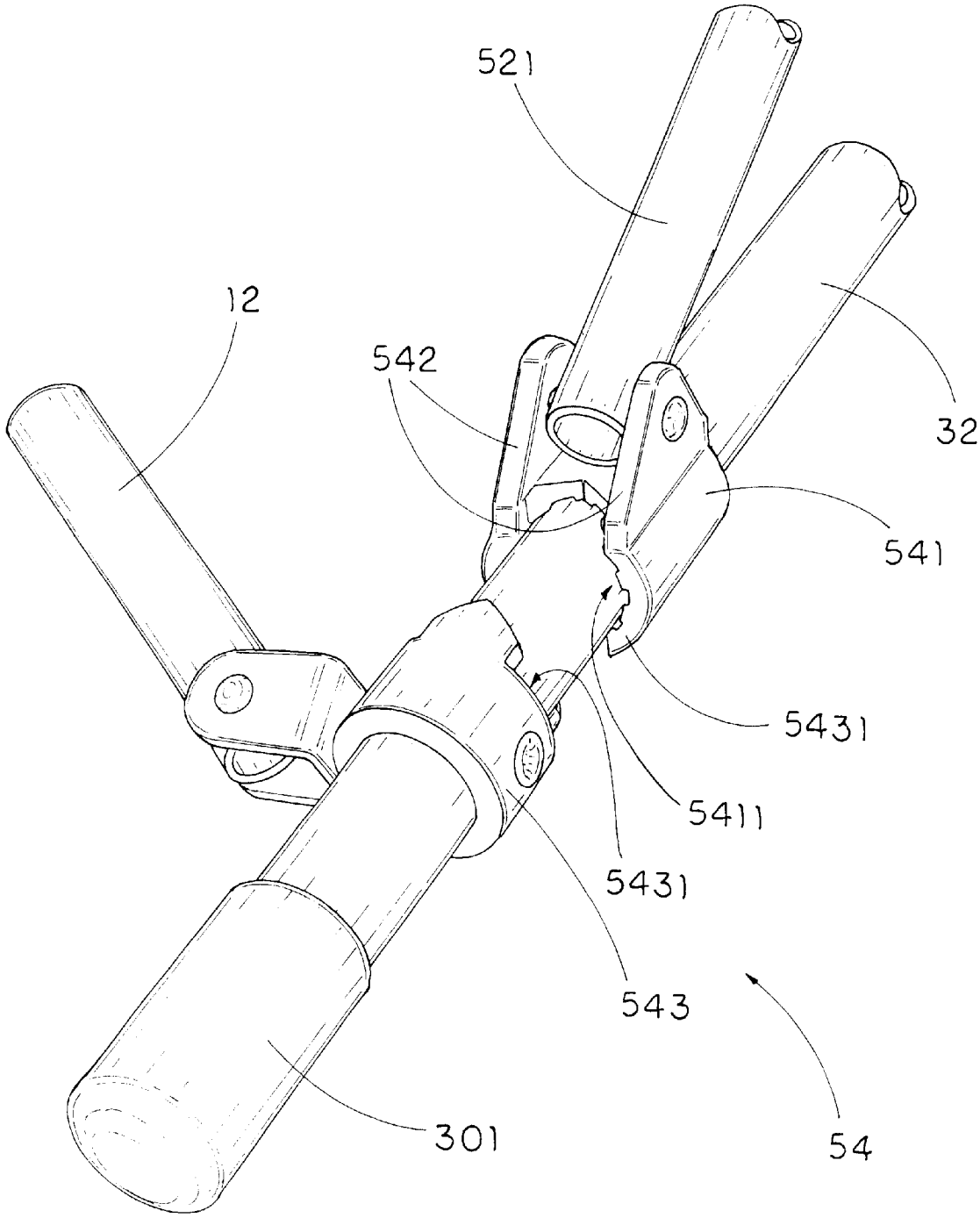
FIG. 4 is a perspective view of a sliding joint of the foldable chair according to the above first preferred embodiment of the present invention.

The armrest arrangement 50 further comprises two sliding joints 54 for slidably connecting the bottom ends of the arm supports 521 with the front side frame legs 32 respectively, wherein each of the sliding joints 54 comprises a tubular joint body 541 having a coaxial slider slot 5411 for the respective front side frame leg 32 slidably passing through and a pivot wall 542 integrally extended from the joint body 541 to pivotally connect the bottom end of the respective arm support 521, as shown in FIG. 4.

In order to limit the downward sliding movement of the joint body 541 along the front side frame leg 32, each of the sliding joints 54 further comprises a blocking stopper 543 attached to a lower portion of the respective front side frame leg 32, in such a manner that the joint body 541 is capable of downwardly sliding along the respective front side frame leg 32 until the joint body 541 is substantially biased against the respective blocking stopper 543.

As shown in FIG. 4, each of the joint bodies 541 has a bottom engaging surface 5412 and each of the blocking stoppers 543 has a top blocking surface 5431 arranged to engage with the engaging surface 5412 of the respective joint body 541 so as to prevent the lateral movement of the joint body 541 on the blocking stopper 543. Accordingly, each of the joint body 541 has at least an indention groove formed on the engaging surface 5412 and each of the blocking stopper 543 has at least a corresponding protrusion extended from the blocking surface 5431 wherein the protrusion of the blocking stopper 543 is arranged to insert into the indention groove of the joint body 541 when the blocking surface 5431 of the blocking stopper 543 is engaged with the engaging surface 5412 of the joint body 541 so as to securely hold the joint body 541 in position.

Accordingly, the sliding joints 54 function as a supporter adapted for distributing the downward pulling force of the user's weight to the chair frame 1 through the armrest arrangement 50, so that the chair frame 1 is capable of supporting more weight comparing with the convention chair frame. Moreover, the armrest arrangement 50 functions as the retaining means 40 to retain the chair frame 1 in the unfolded position that when the joint body 541 is biased against the blocking stopper 543, the arm rest 51, the arm support 521, and the front side frame leg 32 form as a rigid triangular structure to substantially support the chair frame 1 in the unfolded position.

Figure 6:
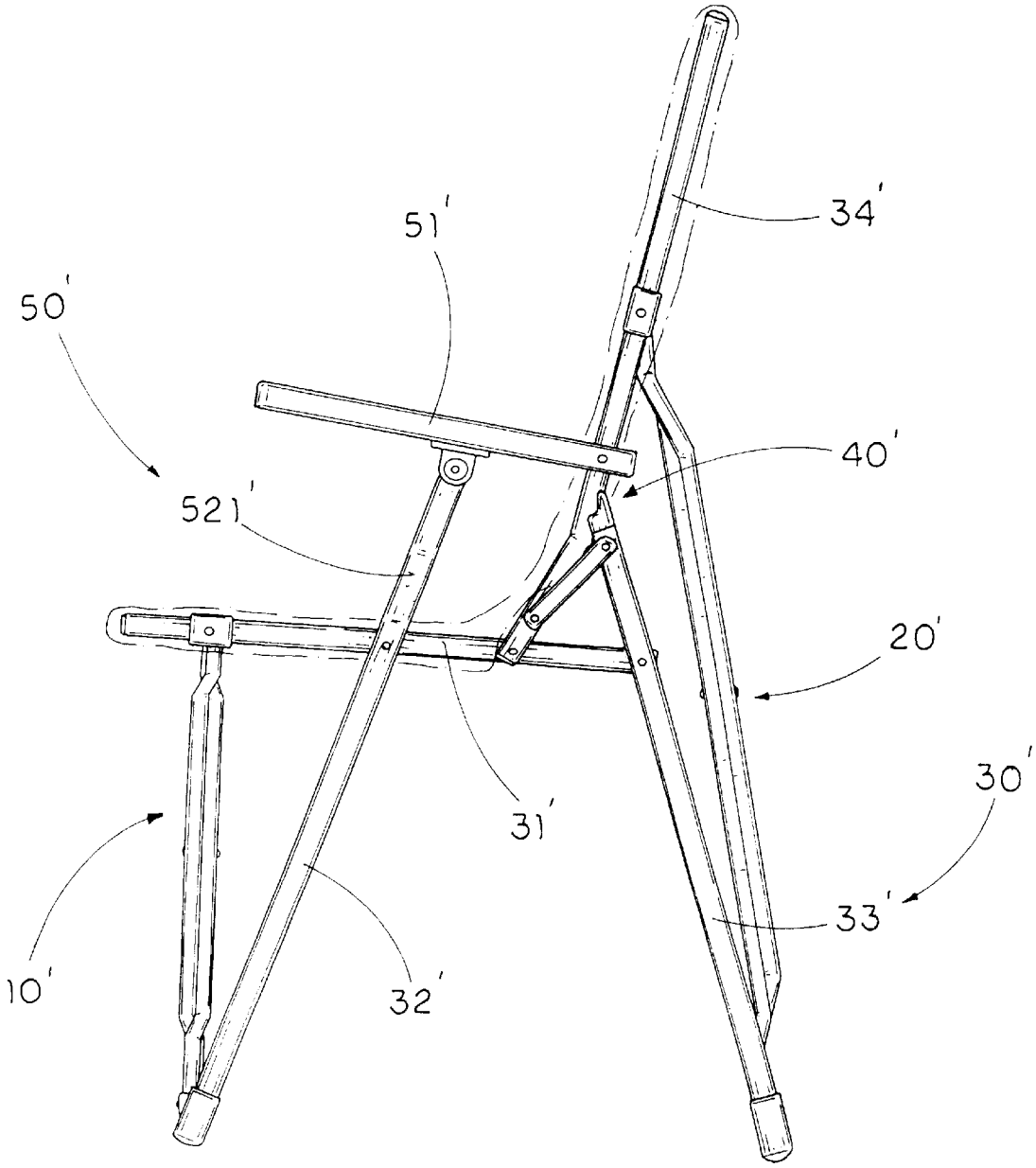
FIG. 6 is a side view of a foldable chair according to a second preferred embodiment of the present invention.

As shown in FIG. 6, a foldable chair according to a second embodiment illustrates an alternative mode of the first embodiment of the present invention, wherein the foldable chair of the second embodiment comprises the same components of the first embodiment thereof, such as the front frame 10' and the rear frame 20', except the structural arrangement of the side frames 30' with the armrest arrangement 50'.

According to the second embodiment, the bottom ends of the back supporting legs 34', embodying as the retaining means 40', are pivotally connected to the seat side supports 31' respectively wherein the upper end of the rear side frame legs 33' are arranged to bias against the back supporting arms 34' respectively so as to retain the chair frame 1' in an unfolded position.

The front side frame legs 32' are upwardly extended above the seat side supports 31' to form the arm supports 521' respectively such that the arm supports 521' are integrally extended from the front side frame legs 32' to slidably connect to the arm rest 51' respectively. Therefore, the downward pulling force of the user's weight can directly distribute through the entire chair frame 1'.

According to the preferred embodiments of the present invention disclosed above, the structural design of the foldable chair is capable of supporting more weight than the conventional cubic structure of the collapsible chair. When the user sits on the foldable chair, the user's weight applying downward pulling force will be more evenly distributed through the entire chair frame. Moreover, since the supporting area of the chair seat is largely increased by the two side frames, the foldable chair of the present invention is more durable and comfortable.

What is claimed is:

1. A foldable chair, comprising a chair frame and a chair seat supported by said chair frame, wherein said chair frame comprises:

a front frame comprising a first front frame leg and a second front frame leg pivotally connected with each other to form a "X" structure;

a rear frame comprising a first rear frame leg and a second rear frame leg pivotally connected with each other to form a "X" structure;

two side frames, each comprising a seat side support, a front side frame leg upwardly and rearwardly extending to pivotally connect with said seat side support, and a rear side frame leg upwardly and frontwardly extending to pivotally connect with said seat side support, each of said side frames further comprising a back supporting arm upwardly extended from said respective seat side support, wherein said first and second front frame legs of said front frame are pivotally connected between front sides of said side frames, wherein upper ends of said first and second rear frame legs of said rear frame are pivotally connected to said back supporting arms respectively while bottom ends of said first and second rear frame legs are pivotally connected to said rear side frame legs respectively, wherein a bottom portion of each of said front and rear side frame legs defines a ground portion of said chair frame and forms as a ground supporting post for supporting said chair frame; and means for retaining said chair frame at an unfolded position, wherein at said unfolded position, said front side frame leg is pivotally moved to said rear side frame leg of each of said side frames at a folding angle while said front and rear frames are pivotally folding to lengthen a distance between said side frames, and at a folded position, said front side frame leg is pivotally moved toward said rear side frame leg of each of said side frames to minimize said folding angle thereof while said front and rear frames are pivotally folding to minimize said distance between said two side frames.

2. A foldable chair, as recited in claim 1, wherein said front side frame legs of said side frames are integrally extending above said seat side supports to form said back supporting arms respectively, wherein two upper ends of said rear side frame legs are upwardly extended above said seat side supports to bias against said back supporting arms respectively at said unfolded position of said chair frame so as to retain said folding angle between said front and rear side frame legs of each of said side frames.

3. A foldable chair, as recited in claim 1, wherein said chair seat comprises a seat support having two side edge portions substantially mounted on said seat side supports respectively and a thigh supporting flap integrally and frontwardly extended from a front end of said support, wherein each of said side frames further comprises a thigh supporting arm frontwardly and integrally extended from said respective seat side support, said thigh supporting arms being connected to two side edges of said thigh supporting flap to substantially increase a seat area of said seat support of said chair seat.

4. A foldable chair, as recited in claim 1, wherein two bottom ends of said back supporting arms are pivotally connected to said seat side supports respectively, wherein two upper ends of said back side frame legs are upwardly extended above said seat side supports to bias against said back supporting arms respectively at said unfolded position of said chair frame so as to retain said folding angle between said front and rear side frame legs of each of said side frames.

5. A foldable chair, as recited in claim 4, wherein said two front side frame legs are upwardly extended above said seat side supports to form two arm supports respectively such that said arm supports are integrally extended from said front side frame legs to slidably connect to said arm rest respectively.

6. A foldable chair, as recited in claim 1, further comprising an armrest arrangement which comprises two arm rests pivotally connected to said back supporting arms respectively and means for supporting each of said arm rests at said unfolded position of said chair frame, wherein at said folded position, said arm rests are pivotally and upwardly folded towards said back supporting arms respectively, and at said unfolded position, said arm rests are pivotally folded to transversely extend from said back supporting arms so as to provide two arm resting surfaces respectively for substantially supporting arms of a user thereon.

7. A foldable chair, as recited in claim 6, wherein said supporting means comprises two arm supports, which are pivotally connected to said seat side supports respectively, wherein each of said arm supports has an upper end slidably connected to said respective arm rest in such a manner that when said arm rests are upwardly folded towards said back supporting arms respectively, said seat side supports are pivotally pulled upward through said arm supports respectively.

8. A foldable chair, as recited in claim 7, wherein said chair seat comprises a seat support having two side edge portions substantially mounted on said seat side supports respectively and a thigh supporting flap integrally and frontwardly extended from a front end of said support, wherein each of said side frames further comprises a thigh supporting arm frontwardly and integrally extended from said respective seat side support, said thigh supporting arms being connected to two side edges of said thigh supporting flap to substantially increase a seat area of said seat support of said chair seat.

9. A foldable chair, as recited in claim 7, wherein said arm supports are extended downwardly until bottom ends of said arm supports are slidably connected to said front side frame legs respectively.

10. A foldable chair, as recited in claim 9, wherein said front side frame legs of said side frames are integrally extending above said seat side supports to form said back supporting arms respectively, wherein two upper ends of said rear side frame legs are upwardly extended above said seat side supports to bias against said back supporting arms respectively at said unfolded position of said chair frame so as to retain said folding angle between said front and rear side frame legs of each of said side frames.

11. A foldable chair, as recited in claim 9, wherein said armrest arrangement further comprises two sliding joints for slidably connecting said bottom ends of said arm supports with said front side frame legs respectively, wherein each of said sliding joints comprises a tubular joint body having a coaxial slider slot for said respective front side frame leg slidably passing through and a pivot wall integrally extended from said joint body to, pivotally connect said bottom end of said respective arm support.

12. A foldable chair, as recited in claim 11, wherein each of said sliding joints further comprises a blocking stopper attached to a lower portion of said respective front side frame leg in such a manner that said joint body is capable of downwardly sliding along said respective front side frame leg until said joint body is substantially biased against said respective blocking stopper.

13. A foldable chair, as recited in claim 7, wherein each of said arm rests has a tubular shape and an elongated slider slot provided along a bottom side thereof, wherein said armrest arrangement further comprises two sliding members slidably inserted into said arm rests respectively, said upper ends of said arm supports being pivotally connected to said sliding members through said slider slots respectively in such a manner that when said arm rests are pivotally folded with respect to said back supporting arms, said upper ends of said arm supports are guided to slide along said slider slots of said arm rests respectively.

14. A foldable chair, as recited in claim 13, wherein two bottom ends of said back supporting arms are pivotally connected to said seat side supports respectively, wherein two upper ends of said back side frame legs are upwardly extended above said seat side supports to bias against said back supporting arms respectively at said unfolded position of said chair frame so as to retain said folding angle between said front and rear side frame legs of each of said side frames.

15. A foldable chair, as recited in claim 14, wherein said front side frame legs are upwardly extended above said seat side supports to form said arm supports respectively such that said arm supports are integrally extended from said front side frame legs to slidably connect to said arm rest respectively.

16. A foldable chair, as recited in claim 15, wherein said chair seat comprises a seat support having two side edge portions substantially mounted on said seat side supports respectively and a thigh supporting flap integrally and frontwardly extended from a front end of said support, wherein each of said side frames further comprises a thigh supporting arm frontwardly and integrally extended from said respective seat side support, said thigh supporting arms being connected to two side edges of said thigh supporting flap to substantially increase a seat area of said seat support of said chair seat.

17. A foldable chair, as recited in claim 6, wherein said supporting means comprises two arm supports each having an upper end slidably connected to said respective arm rest and a bottom end slidably connected to said front side frame leg.

18. A foldable chair, as recited in claim 17, wherein each of said arm rests has a tubular shape and an elongated slider slot provided along a bottom side thereof, wherein said armrest arrangement further comprises two sliding members slidably inserted into said arm rests respectively, said upper ends of said arm supports being pivotally connected to said sliding members through said slider slots respectively in such a manner that when said arm rests are pivotally folded with respect to said back supporting arms, said upper ends of said arm supports are guided to slide along said slider slots of said arm rests respectively.

19. A foldable chair, as recited in claim 17, wherein said front side frame legs of said side frames are integrally extending above said seat side supports to form said back supporting arms respectively, wherein two upper ends of said rear side frame legs are upwardly extended above said seat side supports to bias against said back supporting arms respectively at said unfolded position of said chair frame so as to retain said folding angle between said front and rear side frame legs of each of said side frames.

20. A foldable chair, as recited in claim 19, wherein said chair seat comprises a seat support having two side edge portions substantially mounted on said seat side supports respectively and a thigh supporting flap integrally and frontwardly extended from a front end of said support, wherein each of said side frames further comprises a thigh supporting arm frontwardly and integrally extended from said respective seat side support, said thigh supporting arms being connected to two side edges of said thigh supporting flap to substantially increase a seat area of said seat support of said chair seat.

21. A foldable chair, as recited in claim 17, wherein said armrest arrangement further comprises two sliding joints for slidably connecting said bottom ends of said arm supports with said front side frame legs respectively, wherein each of said sliding joints comprises a tubular joint body having a coaxial slider slot for said respective front side frame leg slidably passing through and a pivot wall integrally extended from said joint body to pivotally connect said bottom end of said respective arm support.

22. A foldable chair, as recited in claim 21, wherein each of said sliding joints further comprises a blocking stopper attached to a lower portion of said respective front side frame leg in such a manner that said joint body is capable of downwardly sliding along said respective front side frame leg until said joint body is substantially biased against said respective blocking stopper.

23. A foldable chair, comprising a chair frame, a chair seat supported by said chair frame, and an armrest arrangement;

wherein said chair frame comprises:

a front frame comprising a first front frame leg and a second front frame leg pivotally connected with each other to form a "X" structure;

a rear frame comprising a first rear frame leg and a second rear frame leg pivotally connected with each other to form a "X" structure;

two side frames, each comprising a seat side support, a front side frame leg upwardly and rearwardly extending to pivotally connect with said seat side support, and a rear side frame leg upwardly and frontwardly extending to pivotally connect with said seat side support, wherein said first and second front frame legs of said front frame are pivotally connected between front sides of said side frames and said first and second rear frame legs of said rear frame are pivotally connected between rear sides of said side frames, each of said side frames further comprising a back supporting arm upwardly extended from said respective seat side support; and means for retaining said chair frame at an unfolded position, wherein at said unfolded position, said front side frame leg is pivotally moved to said rear side frame leg of each of said side frames at a predetermined folding angle while said front and rear frames are pivotally folding to lengthen a distance between said side frames, and at a folded position, said front side frame leg is pivotally moved toward said rear side frame leg of each of said side frames to minimize said folding angle thereof while said front and rear frames are pivotally folding to minimize said distance between said two side frames;

wherein said armrest arrangement comprising two arm rests pivotally connected to said back supporting arms respectively and means for supporting said arm rest at said unfolded position of said chair frame, wherein at said folded position, said arm rests are pivotally and upwardly folded towards said back supporting arms respectively, and at said unfolded position, said arm rests are pivotally folded to transversely extend from said back supporting arms so as to provide two arm resting surfaces respectively for substantially supporting arms of a user thereon.

24. A foldable chair, as recited in claim 23, wherein said supporting means comprises two arm supports, which are pivotally connected to said seat side supports respectively, wherein each of said arm supports has an upper end slidably connected to said respective arm rest in such a manner that when said arm rests are upwardly folded towards said back supporting arms respectively, said seat side supports are pivotally pulled upward through said arm supports respectively.

25. A foldable chair, as recited in claim 24, wherein each of said arm rests has a tubular shape and an elongated slider slot provided along a bottom side thereof, wherein said armrest arrangement further comprises two sliding members slidably inserted into said arm rests respectively, said upper ends of said arm supports being pivotally connected to said sliding members through said slider slots respectively in such a manner that when said arm rests are pivotally folded with respect to said back supporting arms, said upper ends of said arm supports are guided to slide along said slider slots of said arm rests respectively.

26. A foldable chair, as recited in claim 24, wherein said arm supports are extended downwardly until bottom ends of said arm supports are slidably connected to said front side frame legs respectively.

27. A foldable chair, as recited in claim 26, wherein said armrest arrangement further comprises two sliding joints for slidably connecting said bottom ends of said arm supports with said front side frame legs respectively, wherein each of said sliding joints comprises a tubular joint body having a coaxial slider slot for said respective front side frame leg to slidably pass therethrough and a pivot wall integrally extended from said joint body to pivotally connect said bottom end of said respective arm support.

28. A foldable chair, as recited in claim 27, wherein each of said sliding joints further comprises a blocking stopper attached to a lower portion of said respective front side frame leg in such a manner that said joint body is capable of downwardly sliding along said respective front side frame leg until said joint body is substantially biased against said respective blocking stopper.

29. A foldable chair, as recited in claim 23, wherein said supporting means comprises two arm supports each having an upper end slidably connected to said respective arm rest and a bottom end slidably connected to said front side frame leg.

30. A foldable chair, as recited in claim 29, wherein each of said arm rests has a tubular shape and an elongated slider slot provided along a bottom side thereof, wherein said armrest arrangement further comprises two sliding members slidably inserted into said arm rests respectively, said upper ends of said arm supports being pivotally connected to said sliding members through said slider slots respectively in such a manner that when said arm rests are pivotally folded with respect to said back supporting arms, said upper ends of said arm supports are guided to slide along said slider slots of said arm rests respectively.

31. A foldable chair, as recited in claim 29, wherein said armrest arrangement further comprises two sliding joints for slidably connecting said bottom ends of said arm supports with said front side frame legs respectively, wherein each of said sliding joints comprises a tubular joint body having a coaxial slider slot for said respective front side frame leg to slidably pass therethrough and a pivot wall integrally extended from said joint body to pivotally connect said bottom end of said respective arm support.

32. A foldable chair, as recited in claim 1, wherein each of said sliding joints further comprises a blocking stopper attached to a lower portion of said respective front side frame leg in such a manner that said joint body is capable of downwardly sliding along said respective front side frame leg until said joint body is substantially biased against said respective blocking stopper.

* * * * *